US006655397B2

(12) United States Patent
Brown et al.

(10) Patent No.: US 6,655,397 B2
(45) Date of Patent: Dec. 2, 2003

(54) ARTICULATING WATER MONITOR CLEANING DEVICE

(75) Inventors: Clinton A. Brown, Baltimore, OH (US); William E. Hellyer, Lancaster, OH (US); Stephen L. Shover, Millersport, OH (US); Ryan M. Tooill, Rushville, OH (US)

(73) Assignee: Diamond Power International, Inc., Lancaster, OH (US)

( * ) Notice: Subject to any disclaimer, the term of this patent is extended or adjusted under 35 U.S.C. 154(b) by 153 days.

(21) Appl. No.: 10/036,173

(22) Filed: Dec. 26, 2001

(65) Prior Publication Data

US 2002/0139402 A1 Oct. 3, 2002

Related U.S. Application Data

(60) Provisional application No. 60/279,066, filed on Mar. 27, 2001.

(51) Int. Cl.[7] ..... B08B 3/02

(52) U.S. Cl. ..... 134/167 R; 134/169 R; 134/198; 134/181

(58) Field of Search ..... 134/166 R, 167 R, 134/169 R, 198, 172, 168 R, 181; 239/195, 750, 752, 753

(56) References Cited

U.S. PATENT DOCUMENTS

| | | | | |
|---|---|---|---|---|
| 914,940 | A | | 3/1909 | Flynn |
| 1,010,028 | A | | 11/1911 | Davies |
| 1,599,283 | A | | 9/1926 | Phillips |
| 1,780,435 | A | | 11/1930 | Miller |
| 2,089,710 | A | | 8/1937 | Reekie |
| 2,146,546 | A | | 2/1939 | Lindermann, Jr. |
| 2,532,447 | A | | 12/1950 | Handoll et al. |
| 2,972,502 | A | | 2/1961 | Jennings et al. |
| 3,599,871 | A | * | 8/1971 | Ruppel |
| 4,424,769 | A | * | 1/1984 | Charamathieu et al. |
| 4,603,661 | A | * | 8/1986 | Nelson et al. |
| 5,036,871 | A | * | 8/1991 | Ruggieri et al. |
| 5,194,217 | A | * | 3/1993 | St. Louis et al. |
| 5,201,281 | A | * | 4/1993 | Cella |
| 5,411,043 | A | * | 5/1995 | Kamler |
| 5,460,193 | A | * | 10/1995 | Levallois et al. |
| 5,503,115 | A | | 4/1996 | Franzke et al. |
| 5,514,219 | A | * | 5/1996 | Kamler |
| 5,782,255 | A | * | 7/1998 | Magnin et al. |
| 5,823,209 | A | | 10/1998 | Kleye et al. |
| 5,882,430 | A | | 3/1999 | Kleye et al. |
| 5,925,193 | A | | 7/1999 | Bude et al. |
| 6,035,811 | A | | 3/2000 | Bude et al. |
| 6,073,641 | A | | 6/2000 | Bude et al. |
| 6,101,985 | A | | 8/2000 | Bude et al. ..... 122/379 |
| 6,192,904 | B1 | * | 2/2001 | Secknus et al. |
| 6,283,069 | B1 | | 9/2001 | Bude et al. ..... 122/379 |
| 2002/0040691 | A1 | | 4/2002 | Stewart et al. ..... 122/493 |

FOREIGN PATENT DOCUMENTS

| | | |
|---|---|---|
| DE | 281 452 A5 | 7/1987 |
| DE | 281 468 A4 | 7/1987 |
| EP | 0 679 855 A1 | 11/1995 |
| JP | 3-186105 | 8/1991 |
| RU | 779 800 | 5/1977 |

* cited by examiner

*Primary Examiner*—Frankie L. Stinson
(74) *Attorney, Agent, or Firm*—Brinks Hofer Gilson & Lione

(57) ABSTRACT

An articulating water monitor-cleaning device for cleaning internal surfaces of large-scale combustion devices. The device is mounted to the exterior of a wall of a combustion device and positions a water spray lance to direct a stream of water against internal surfaces over a range of position. Pairs of orthogonally oriented four-bar linkage assemblies are provided, each having rotary actuators. The relative position between a pair of joints affixed to the lance tube allows the position of the lance to be set over a range of positions.

22 Claims, 9 Drawing Sheets

24
76
74
44
100
82
34
23
28
12
10
52
48
86
30
20
22
104
50
94
72
70
68
16
66
14
18

ARTICULATING WATER MONITOR CLEANING DEVICE

CROSS REFERENCE TO RELATED APPLICATION

This specification claims priority to U.S. Provisional Patent Application No. 60/279,066, filed on Mar. 27, 2001, entitled "Articulating Water Monitor Cleaning Device".

FIELD OF THE INVENTION

This invention relates to a fluid spraying monitor and, in particular, to one adapted for use in cleaning internal surfaces of large-scale combustion devices.

During the operation of large-scale combustion devices, such as boilers burning fossil fuels, slag and ash encrustations develop on internal surfaces of the device. The presence of these deposits degrades the thermal efficiency of the combustion device. Therefore, it is periodically necessary to remove such encrustations. Various techniques are presently used. In some cases, vibration is used to mechanically remove such deposits. Devices referred to as "sootblowers" are used to project a stream of a fluid cleaning medium, such as air, steam or water, against the internal surfaces. In the case of long retracting type sootblowers, a lance tube is periodically advanced into and withdrawn from the boiler and articulated to rotate or oscillate to direct one or more jets of cleaning medium at desired surfaces within the boiler. Sootblower devices are also used which are stationary and maintained in a position within the boiler. Sootblower lance tubes project through openings in the boiler wall, referred to as wall boxes. In cases where it is desired to clean the interior wall area surrounding the wall box, so called wall blowers are used. These devices incorporate a lance tube with nozzles directed back at the wall through which the lance tube is projected.

Another class of boiler cleaning devices is used which are designed to clean a wall surface other than the one in which the wall box is installed using water as the cleaning fluid. These devices are sometimes referred to as "water cannons". They involve the use of a monitor or nozzle positioned within a wall box that creates a jet of water or another fluid which passes through a portion of the interior of the boiler and strikes an opposing wall or other surface to be cleaned. Early versions of these devices were manually articulated to allow the stream to be aimed at particular areas to be cleaned. More recently, however, articulating devices operated under programmed numerical control periodically cause the water cannon lance to trace a prescribed spray pattern on the opposing wall or other surface to be cleaned. This invention is related to such a water cannon device which will also be referred to in this description as an articulating water monitor cleaning device.

In accordance with this invention, an articulating monitor-cleaning device is designed principally for ejecting water which incorporates a pair of orthogonally oriented articulating four-bar linkages which are mechanically actuated. One of the linkage arms or links is coupled to the lance tube near its inlet end. The other discharge end of the lance tube where a nozzle is present is mounted to the wall box and is allowed to freely pivot at the wall box. Using a pair of rotary actuators, each of the pairs of four-bar linkages can be actuated to a prescribed angle. By adjusting the angles of the four-bar linkages, a prescribed aiming position on the lance tube can be achieved. Under programmed control, a desired motion sequence can be executed to trace a desired pattern for the jet ejected from the water lance.

The device according to this invention further includes mechanisms to improve the mechanical stability of the drive. This is principally achieved by providing redundant four-bar linkages which are not driven but follow the motion of the actuated or driving four-bar linkage. The geometric relationship of the elements comprising the four-bar linkage are selected such that movement of an actuating axle translates directly to an equivalent motion of the lance tube over a range of motion. This is achieved by four-bar linkages which are based on links defining a parallelogram, that is, opposing links have equal lengths. Another feature of this invention provides a system including a subassembly which can be conventionally mounted to the associated boiler.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
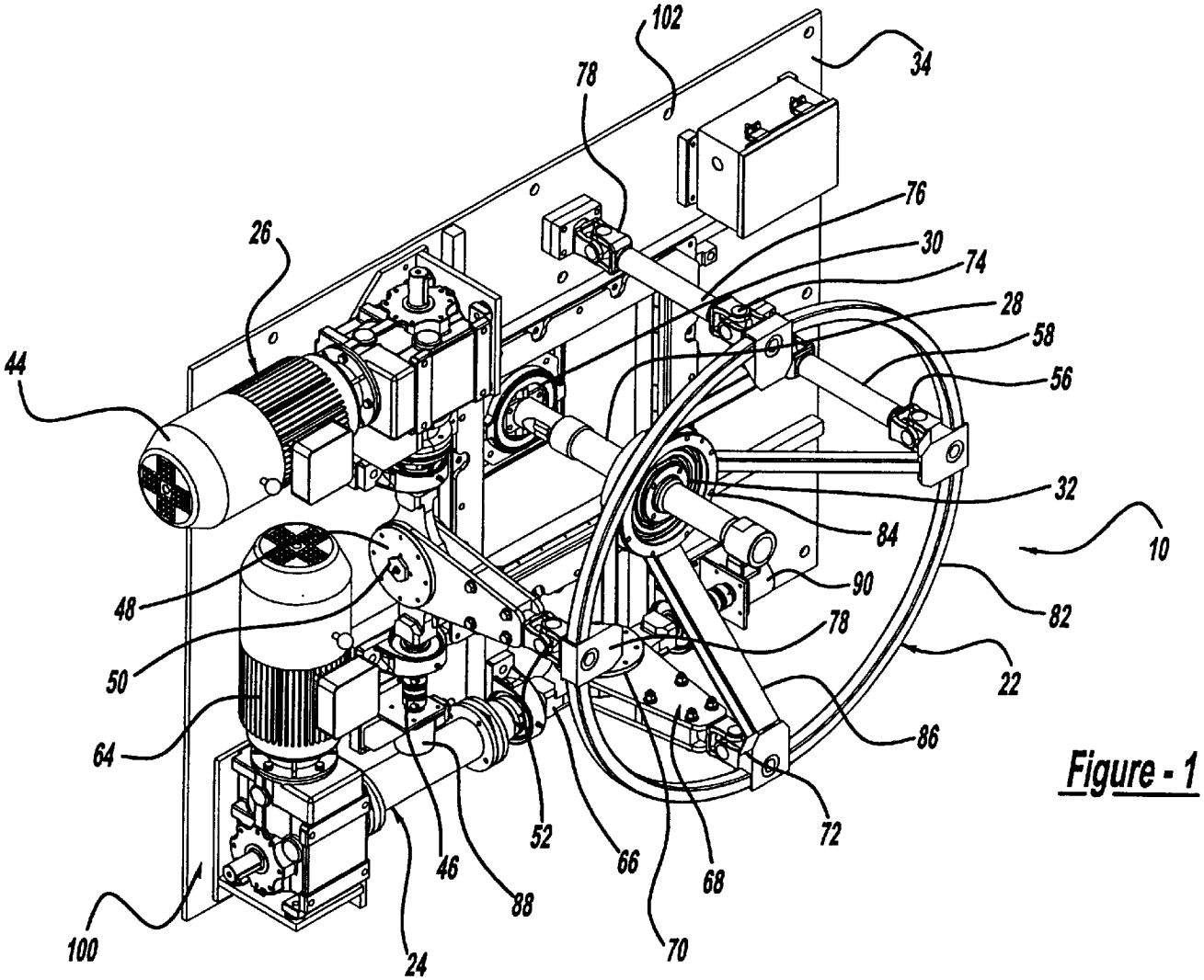
FIG. 1 is a pictorial view showing the fully assembled articulating water monitor cleaning device in accordance with this invention.

The cleaning device in accordance with this invention is generally designated by reference number 10 and is shown mounted to a boiler wall 12 in the figures. The details of boiler wall 12 are best described in connection with FIGS. 2 through 6. Boiler wall 12 includes an outer protective metal sheeting layer 14 and a plurality of steam pipes 16 exposed to the interior of the associated boiler. Insulation layer 18 separates sheeting layer 14 from steam pipes 16. Steam pipes 16 are provided for transferring heat from the internal combustion process as part of the thermal conversion process of the overall system. A portion of the boiler wall 12 includes a through port allowing installation of cleaning device 10 and is generally referred to as a wall port 20. Additional details regarding wall port 20 are provided later in this description.

Cleaning device 10 principally includes stabilizing ring assembly 22, horizontal motion actuator assembly 26, vertical motion actuator assembly 24, and water lance 28. These elements and their associated components will be described in greater detail as follows.

Figure 11:
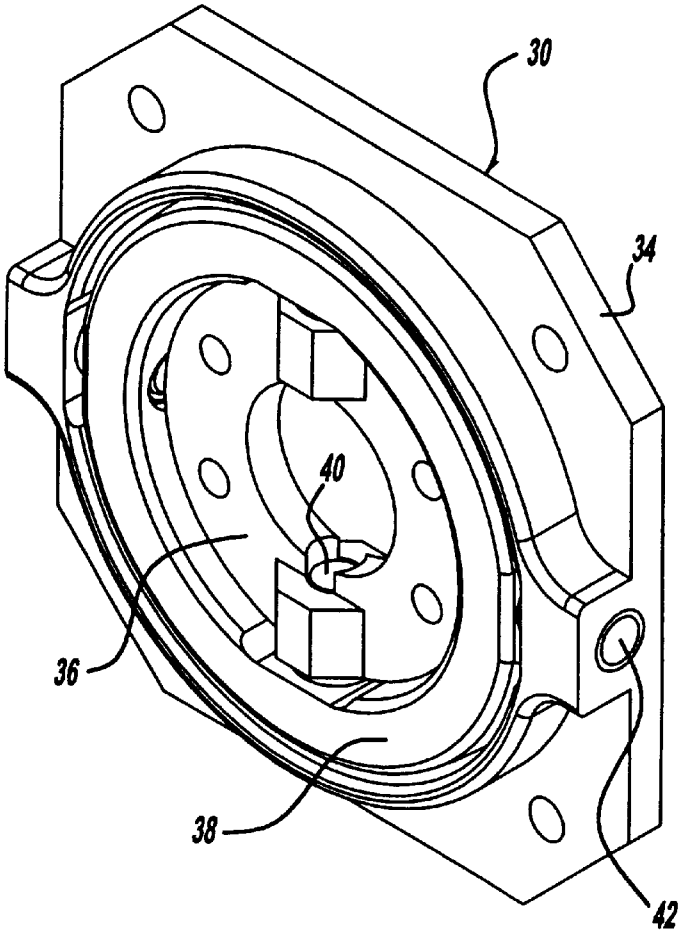
FIG. 11 is a pictorial view of the Cardon joint shown in FIG. 10.
Figure 10:
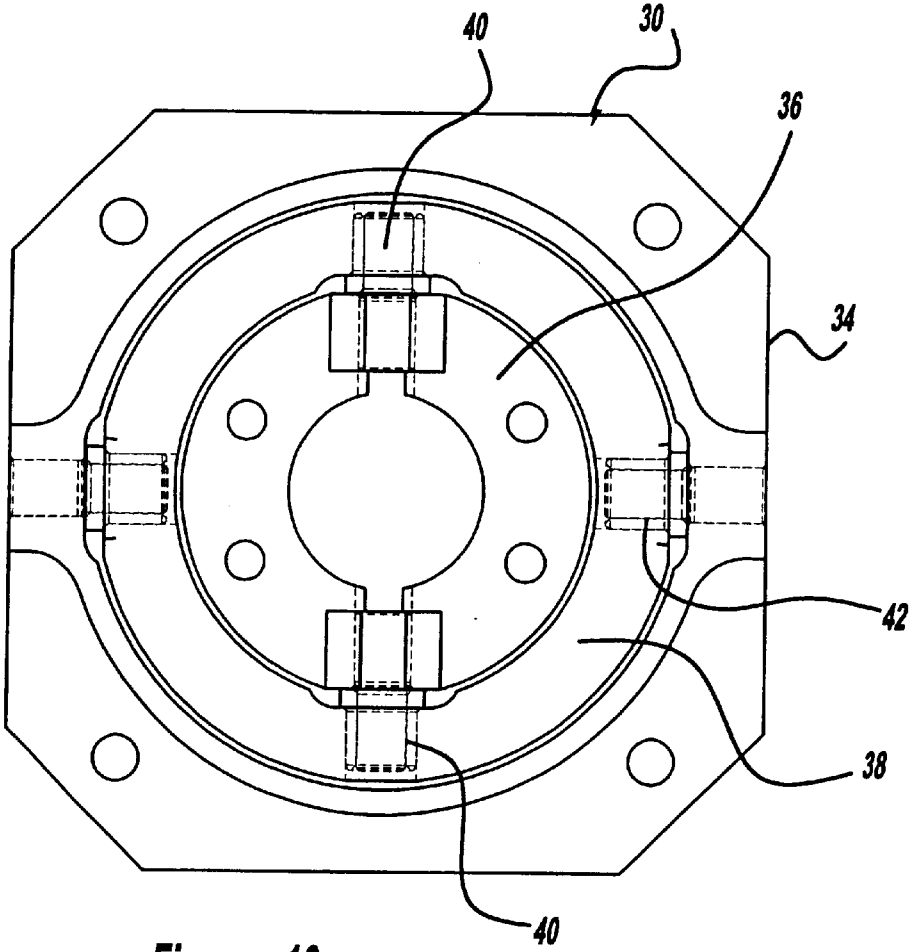
FIG. 10 is a frontal view of the Cardon joint element described in connection with this invention.

The basis of operation of cleaning device 10 is through controlling the directional orientation of water lance 28 through vertical and horizontal displacement of stabilizing ring assembly 22. Water lance 28 is mounted at its water discharge end where a nozzle is present in wall box assembly via Cardon joint 30. Another Cardon joint 32 is in turn supported by stabilizing ring assembly 22 and supports water lance 28 at near its water inlet end. Cardon joints 30 and 32 are hinge devices which allow the freedom of rotation about two non-parallel axes such as vertical and horizontal axes. Thus, these devices operate much like convention universal or "U-joints". As the position of Cardon joint 32 is moved to various positions, water lance 28 is caused to undergo a change in direction. Cardon joint 30 is illustrated in more detail in FIGS. 10 and 11. Cardon joint 30 includes mounting plate 34 and a pair of concentric rings, including inner ring 36 and outer ring 38. Inner ring 36 is mounted to water lance 28 about an associated mounting flange. Inner ring 36 is able to rotate with respect to outer ring 38 about a vertical axis defined by pins 40. Outer ring 38 is able to rotate relative to mounting plate 34 about a horizontal axis defined by pins 42. This configuration permits the angular motion described previously. Cardon joint 32 is assembled in a manner substantially identical with that of Cardon joint 30 but is configured for mounting to stabilizing ring assembly 22. As explained in more detail in the following description, water lance 28 is rigidly mounted to the inner ring of Cardon joint 32, and mounted for sliding engagement with the inner ring 36 of Cardon joint 30.

Movement of stabilizing ring assembly 22 in the horizontal direction is caused by horizontal motion actuator assembly 26 which includes a motion actuator in the form of gear reducer motor unit 44 which causes controlled angular rotation of axle 46. As axle 46 undergoes angular rotation, swing arm assembly 48 also is caused to rotate about a vertical axis. Swing arm assembly 48 is, however, freely permitted to rotate relative to axle 46 about a horizontal axis vertically when stabilizing ring assembly 22 undergoes vertical motion. Swing arm assembly 48 includes bearing 50. Swing arm assembly 48 is in turn coupled with stabilizing ring assembly 22 via flexible or universal joint 52.

Since there is some change in the distance between Cardon joints 30 and 32 during position changes of water lance 28, Cardon joint 32 supports thrust loads acting on lance 28, whereas the lance 28 is permitted to slip axially with respect to Cardon joint 30.

The cleaning medium leaving water lance 28 imparts a thrust force on the lance. In accordance with this invention, lance tube 28 is restrained at the outboard Cardon joint 32, and is allowed to slip axially with respect to the inboard Cardon joint 30. Accommodating the thrust load by the outboard Cardon joint 32 means that the potential for friction wear and galling is born by the Cardon joint 32, removed from the heat of the associated boiler. Wear characteristics of the materials and components making up Cardon joints 30 and 32 are strongly dependent on temperature. Considering the great difference in temperature between the inboard and outboard Cardon joints 30 and 32, respectively (i.e., approximately 1,000° F. versus approximately 300° F.), the wear and service characteristics of this system are enhanced.

At a position on stabilizing ring assembly 22 diametrically opposite the point of connection of universal joint 52, another flexible or universal joint 56 is provided. This universal joint 56 is mounted at one end of linkage arm 58, which is mounted on its opposite end via U-joint 60 to mounting plate assembly 100.

Vertical motion actuator assembly 24 is comprised of components substantially identical with that of horizontal motion actuator assembly 26 and consequently includes a motion actuator in the form of gear reducer motor unit 64. Motor unit 64 drives axle 66 for controlled rotation movement, which carries swing arm assembly 68. Bearing 70 mounts the swing arm assembly 68 to axle 66, but allows free movement of stabilizing ring assembly 22 in the horizontal direction. Thus, the swing arm assembly 68 is permitted to rotate relative to axle 66 about an axis normal to axle 66. The lowermost portion of stabilizing ring assembly 22 is the connection point for swing arm assembly via universal joint 72. At the uppermost segment of stabilizing ring assembly 22, linkage arm 76 is connected at its opposite ends with the stabilizing ring assembly 22 and mounting plate assembly 100 via U-joints 74 and 78, respectively.

With specific reference to FIG. 1, stabilizing ring assembly 22 includes outer ring 82, inner ring 84, and four spokes 86 connecting the two rings. Inner ring 84 is located on a plane displaced from that formed by outer ring 82 toward wall port 20, for reasons which will be described in more detail later in this description. Although outer ring 82 is shown having a circular shape, other shapes could be provided. For example, outer ring 82 could be square in shape formed by straight sides connecting between spokes 86.

Since the angular position of axles 46 and 66 is important in establishing the direction of water lance 28, shaft encoders or resolvers 88 and 90 are provided. Resolvers 88 and 90 provide electrical output establishing the rotated position of the associated axles 46 and 66. These outputs are used with a controller system for cleaning device 10. Motor units 44 and 64 cause rotation of the associated axles 46 and 66 based on control inputs. Due to a high reduction gearing, motor units 44 and 64 inherently resist changes in position of axles 46 and 66 in response to external forces. Thus, axles 46 and 66 will remain in a set angular position without energizing motor units 44 and 64.

Figure 7:
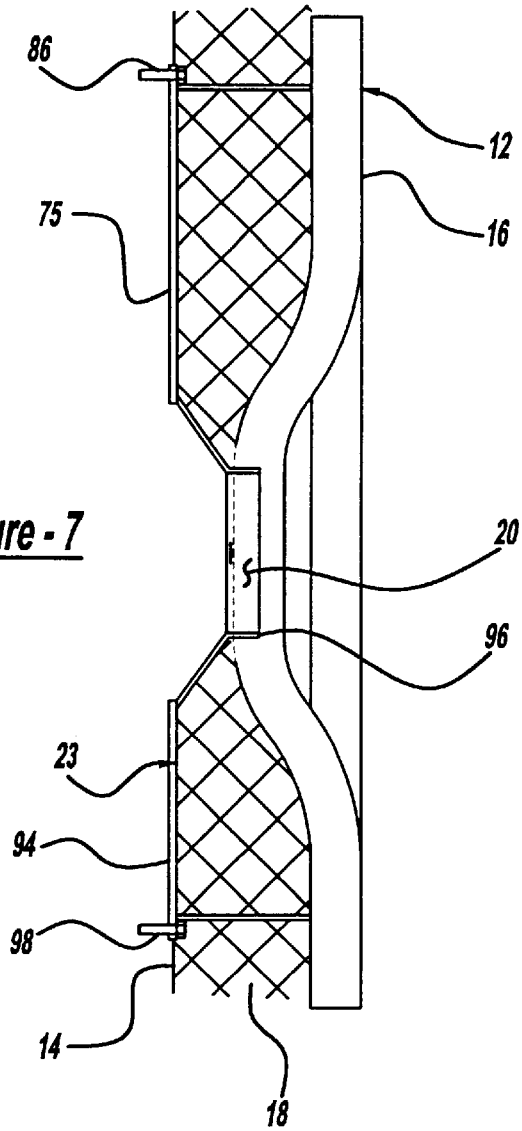
FIG. 7 is a side sectional view taken through the boiler wall showing the seal box assembly mounted to the boiler wall.
Figure 8:
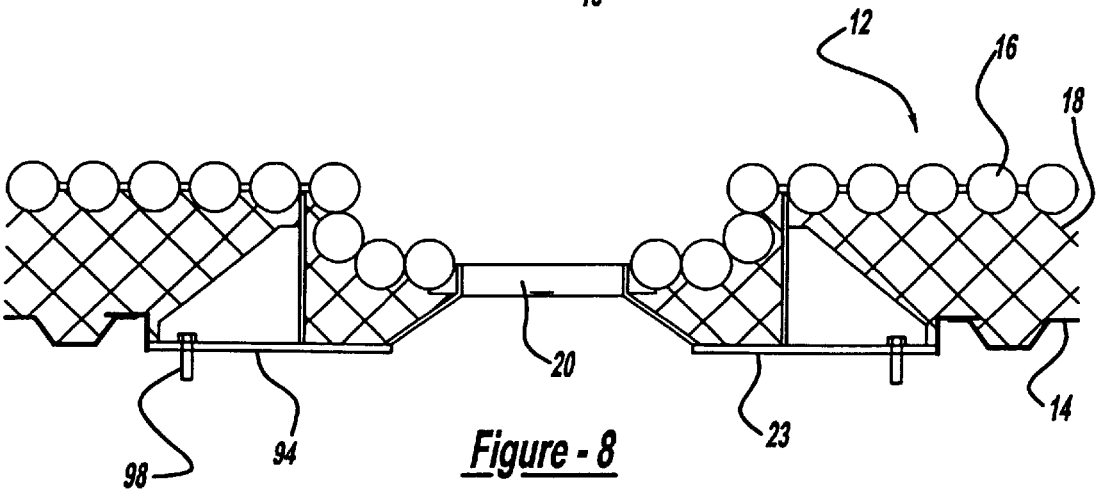
FIG. 8 is a top sectional view through the boiler wall also showing the seal box assembly mounted to the boiler wall.
Figure 9:
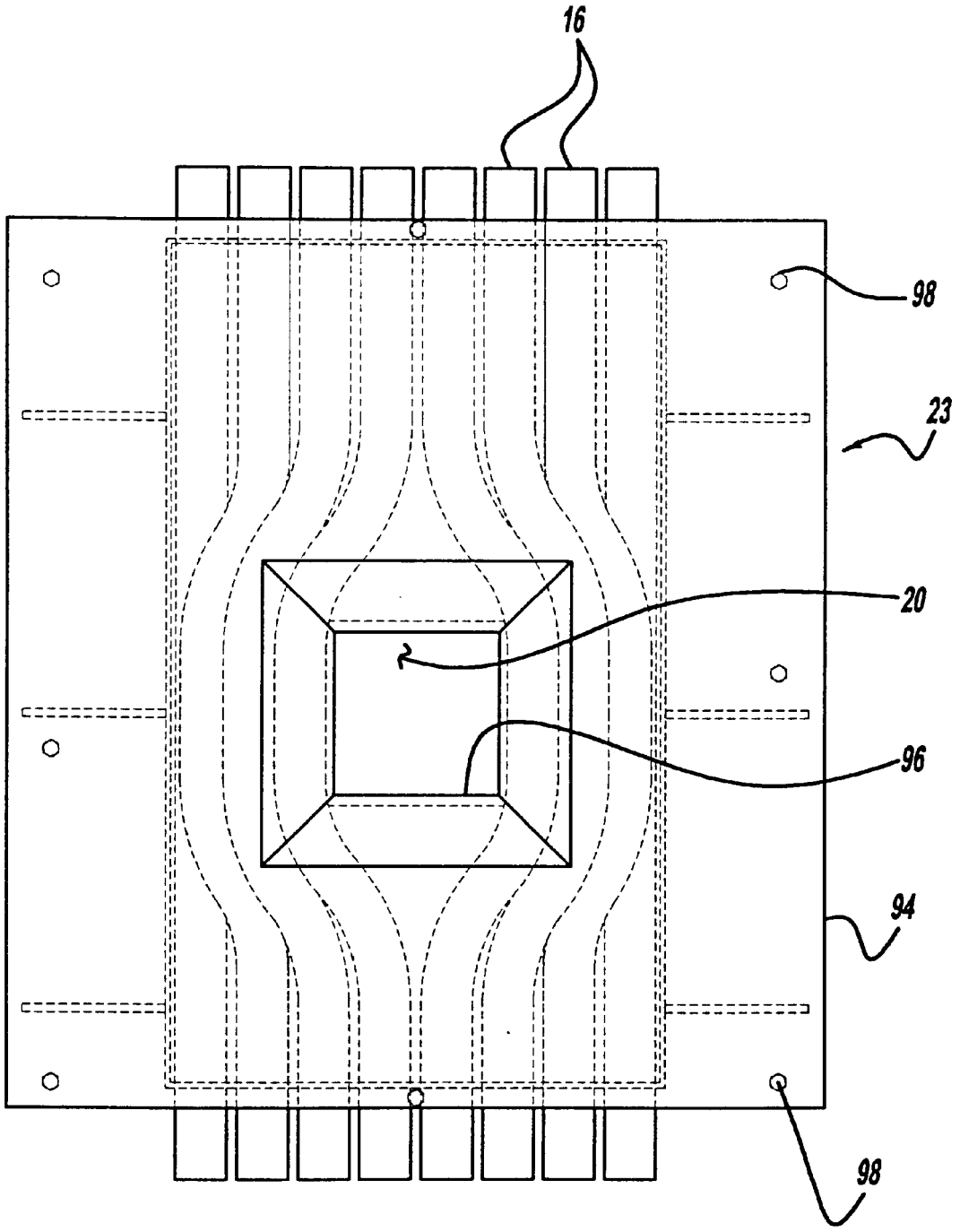
FIG. 9 is a front view of the seal box assembly mounted to the associated boiler wall.

Cleaning device 10 is supported against boiler wall 12 through seal box assembly 23. Seal box assembly 23 includes base plate 94, best shown with reference to FIGS. 7, 8, and 9. Base plate 94 is fastened to boiler wall sheeting layer 14 and includes an inward deflected port 96. A plurality of studs 98 protrude from base plate 94. During installation of cleaning device 10 onto boiler wall 12, base plate 94 is first mounted to the boiler wall by welding or mechanical fasteners (not shown).

Mounting plate assembly 100 has the various components described previously, including gear reducer motor units 44 and 64 mounted thereto. Mounting plate assembly 100 includes bores 102 which correspond in position to protruding studs 98 of seal box assembly 23. Thus, after base plate 94 is fastened to boiler wall 12, mounting plate assembly 100 can be readily placed in position and nuts or other fasteners are used to secure the device against seal box assembly 23. Mounting plate assembly 100 provides a stable platform for mounting of components of the system, and maintaining their alignment. Mounting plate assembly 100 can be fabricated and assembled to boiler wall 12 as a subassembly in a convenient manner.

Since it is desired to isolate the interior of the boiler from the exterior, bellows seal 104 is used and connects between mounting plate assembly 100 and water lance 28. Bellows seal 104 allows for a range of angular motion of water lance 28 yet seals the wall port 10 from gases escaping from the boiler.

Figure 5:
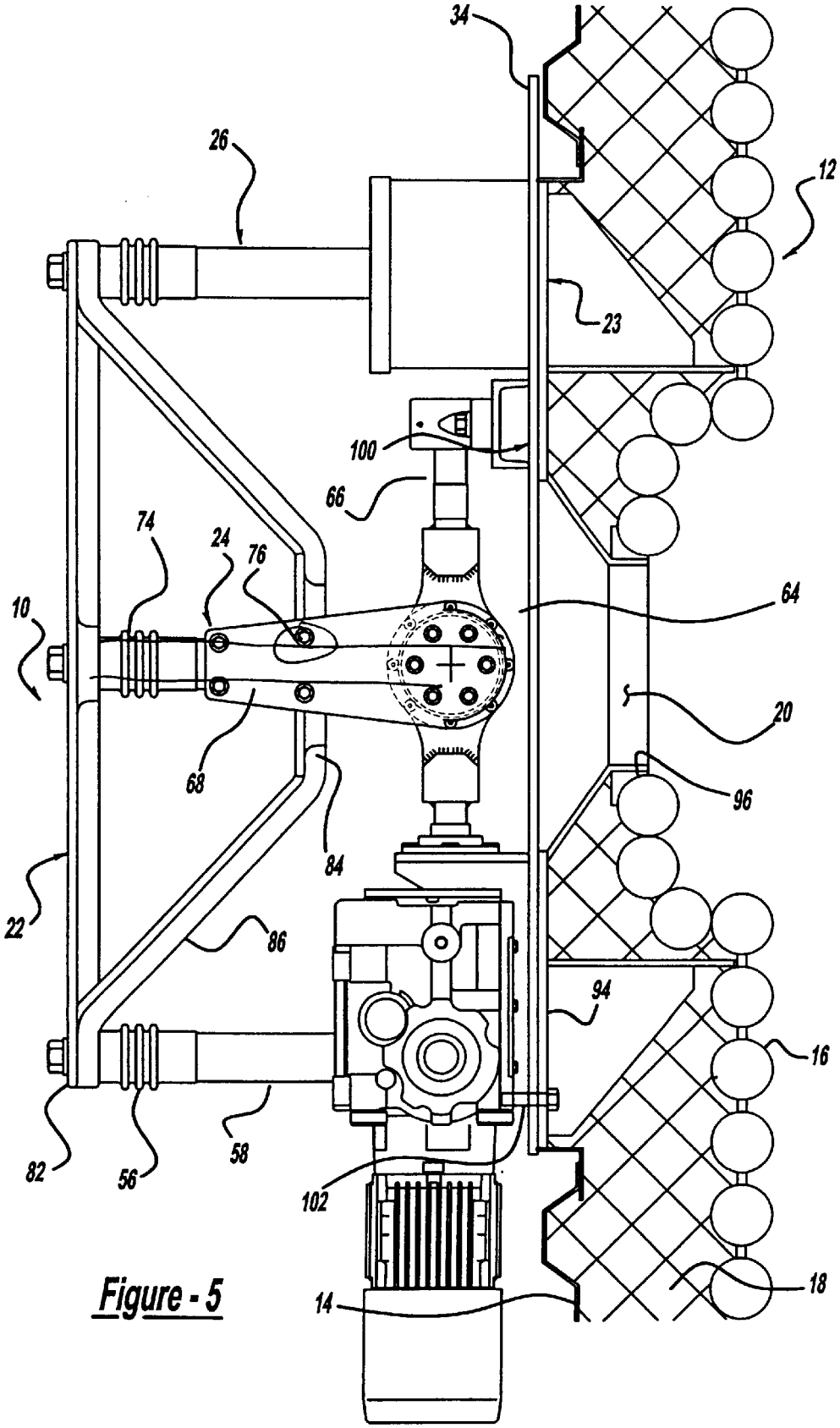
FIG. 5 is a top elevational view of the articulating water monitor cleaning device shown in FIG. 1 further illustrating a portion of the boiler wall in section.
Figure 6:
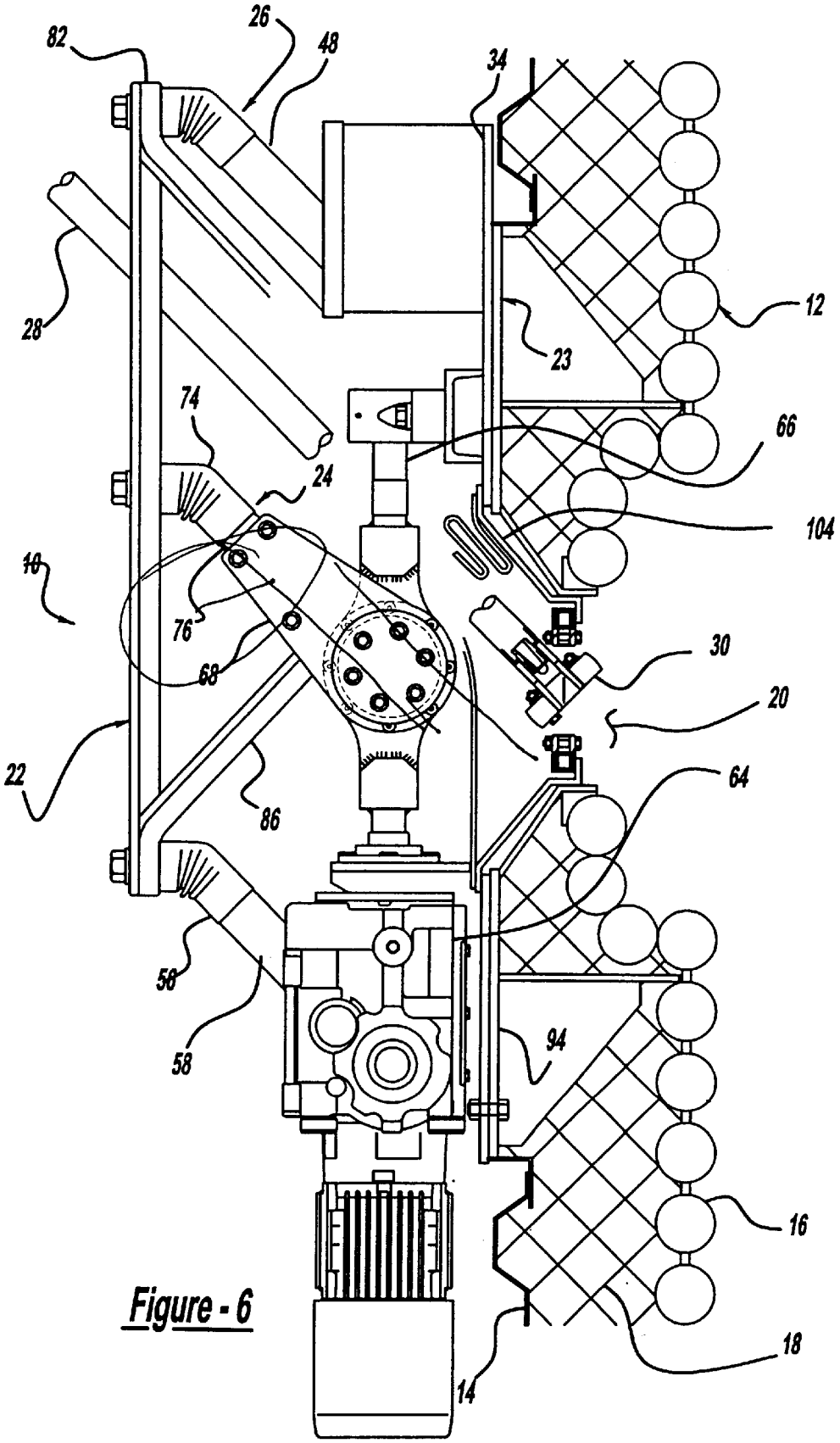
FIG. 6 is a top elevation similar to FIG. 5 but showing the device in an articulated position in the vertical direction to change the aiming direction of the water lance.

Operation of cleaning device 10 will now be described with reference to the figures. When it is desired to cause the spray of water emitted from water lance 28 to move horizontally, gear reducer motor unit 44 is actuated to cause angular displacement of axle 46. This motion in turn rotates swing arm assembly 48, which causes stabilizing ring assembly 22 to be displaced in the horizontal direction. This movement is depicted in FIGS. 5 and 6. The plane of stabilizing ring assembly 22, outer ring 82 (and inner ring 84) remains parallel with that defined by base plate 94 through the articulation of linkage arm 58. During the horizontal displacement of stabilizing ring assembly 22, swing arm 68 freely rotates about its bearing 70.

Figure 3:
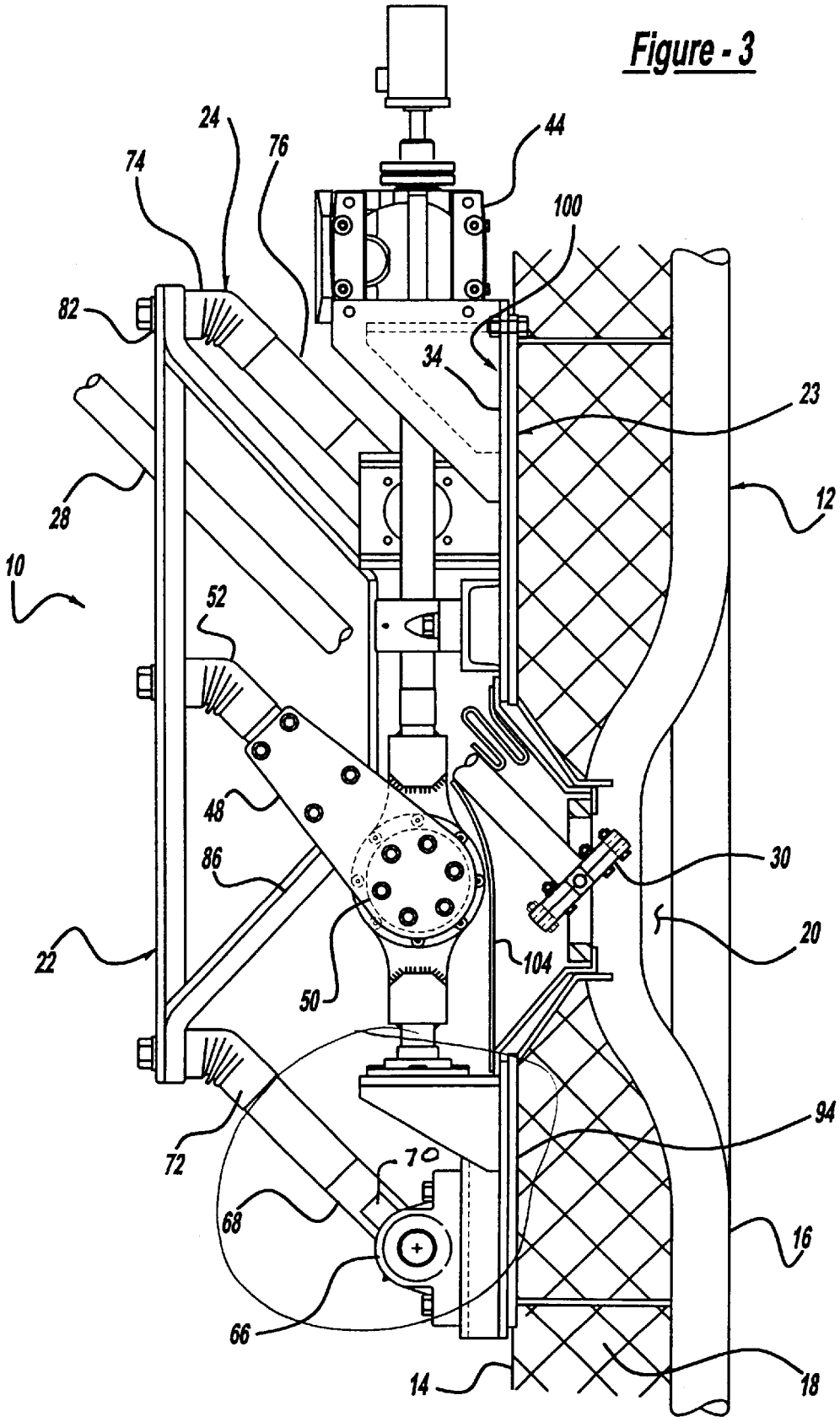
FIG. 3 is a side elevational view similar to FIG. 2 but showing the device articulated in the horizontal direction to change the aiming direction of the water lance.
Figure 4:
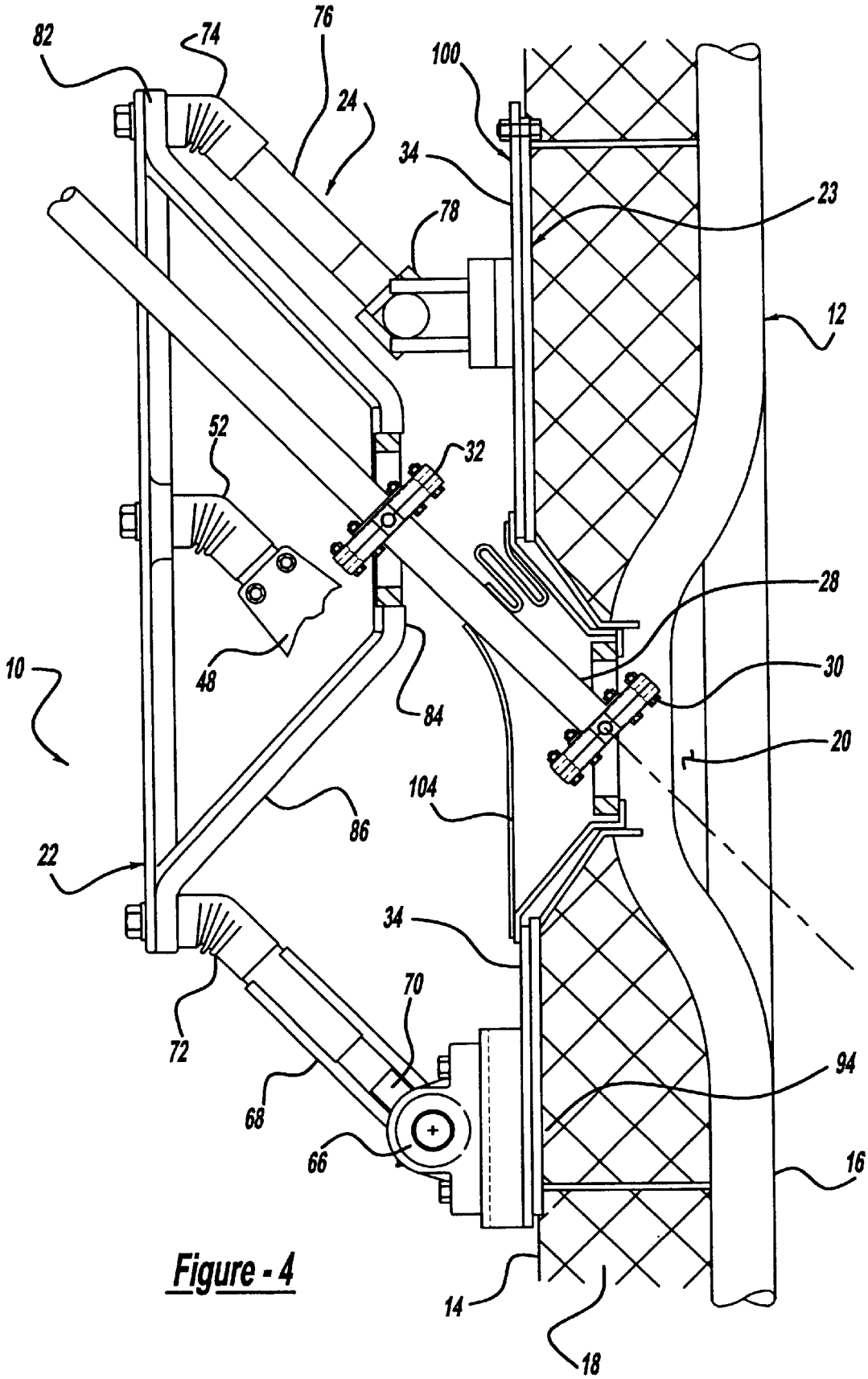
FIG. 4 is another side elevational view similar to FIG. 3 but with certain components removed to more clearly reveal the elements associated with the water lance component.

In a manner similar to articulation in the horizontal direction, vertical displacement is driven by motor unit 64, which controllably rotates axle 66. When this occurs, swing arm assembly 68 is actuated such that U-joint 72 is moved in the vertical direction. As previously described, the plane of stabilizing ring assembly 22 remains parallel to base plate 94 through the articulation of linkage arm 48. FIGS. 3 and 4 illustrate stabilizing ring assembly 22 shifted upwardly.

Figure 2:
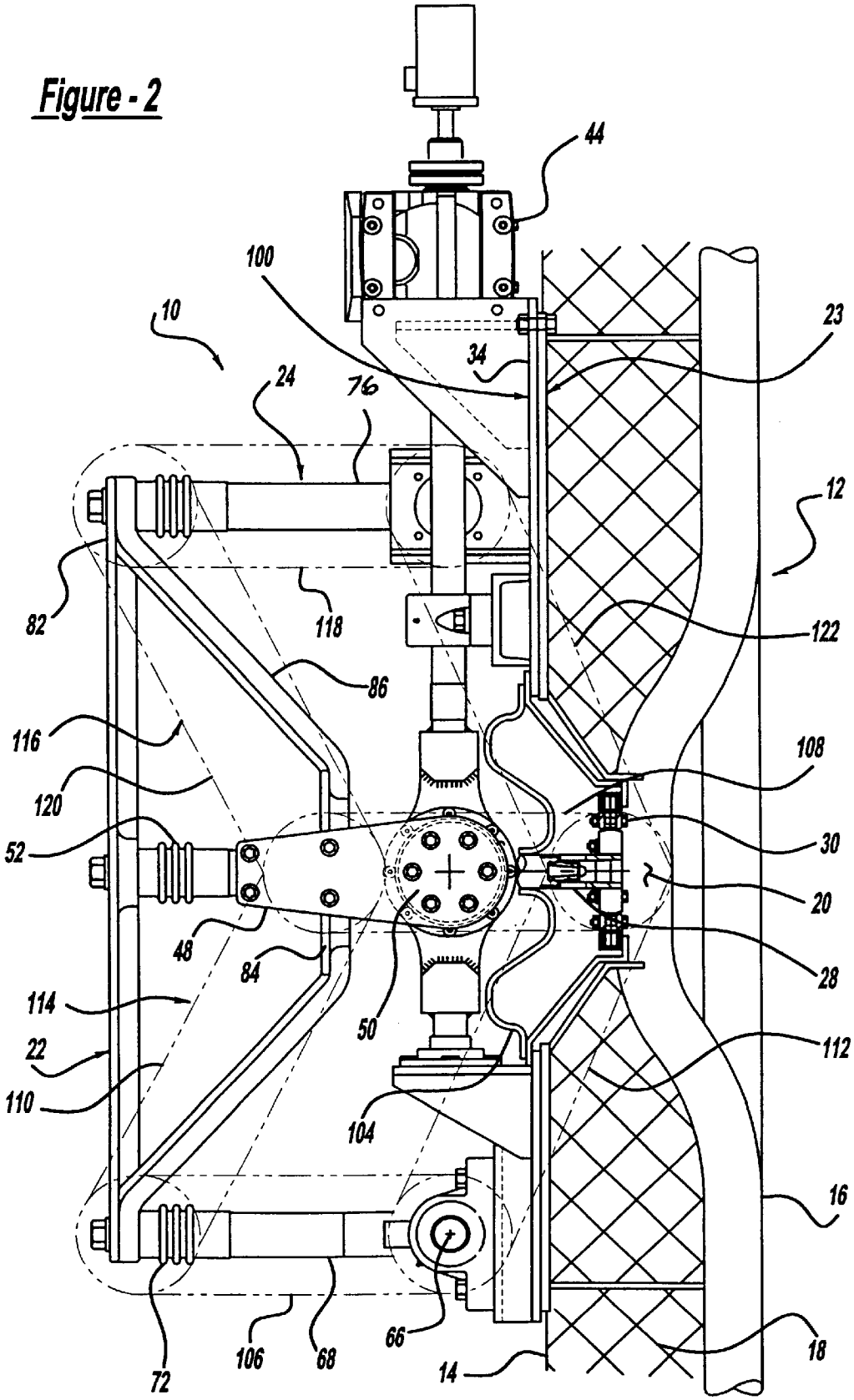
FIG. 2 is a side elevational view of the articulating water monitor cleaning device shown in FIG. 1 and further including a cross-sectional view through an associated boiler wall.

In order to simplify the control approach for the motion of the water monitor cleaning device 10, it is desirable that a constant relationship exists between the angular motion of axles 46 and 66 and the angular position change for water lance 28. The articulation of water lance 28 in both the vertical and horizontal directions can be thought of as being generated by a pair of parallelogram four-bar linkages. Vertical motion is actuated by a four-bar linkage, which is shown in simplified terms by the links drawn in phantom lines in FIG. 2. Swing arm 68 and the lance tube 28 constitute parallel and opposite links 106 and 108, whereas the associated stabilizing ring assembly spoke 86 and the structure of mounting plate assembly 100 comprise the opposing parallel links 110 and 112. Links 106 and 108 are equal in length to one another, as are links 110 and 112. FIG. 2 illustrates the position of the links in a normal non-articulated position of the unit in which case water lance 28 is oriented in a direction normal to that of boiler wall 12. In order to reduce, to the practical extent, the size of wall port 20, it is necessary to mount Cardon joint 30 at the position illustrated in FIG. 2, which is immediately adjacent steam pipe 16. Due to packaging limitations, it is not practical to mount axle 66 in that same plane. In order that links 110 and 112 remain parallel throughout the range of motion of the device, it is necessary for stabilizing ring assembly 22 to have the configuration illustrated in which inner ring 84 is displaced from outer ring 82. With this configuration, the angular positions of links 106 and 108 always remain equal to one another throughout the range of motion, as do links 110 and 112. The horizontal motion actuators and associated linkages have the identical parallelogram four-bar linkage described in FIG. 2.

Due to positive actuation of motor unit 64 which causes swing arm assembly 68 to be rotated to a desired angular position, the cooperation among links 106 and 112 establishes the angular position of water lance 28. Accordingly, the parallelogram four-bar linkage provided by links 106, 108, 110, and 112 can be thought of as constituting a driven or actuated four-bar linkage. Although these elements above are sufficient to establish the position of water lance 28, it is desirable to provide enhanced stability of cleaning device 10. Due to the inherent backlash and clearances provided by each of the connected articulating joints, the use of actuated four-bar link 114 is augmented through the use of a parallel, non-actuated four-bar linkage 116. Non-actuated four-bar linkage 116 is defined by link 108, which is shared with actuated four-bar linkage 114 and opposing link 118 provided by arm 68. An opposed pair of links 120 and 122 formed by a spoke 86 and mounting plate assembly 100 complete the linkage assembly. As in the case of actuated four-bar linkage 114, non-actuated four-bar linkage 116 is also a four-bar parallelogram linkage assembly. Throughout the range of motion, links 106, 108, and 118 always move in unison and undergo an equivalent angular change of direction during actuation. Similarly, links 108 and 118 remain mutually parallel, as do links 120 and 122. Non-actuated four-bar linkage 116 merely follows the motion driven by actuated four-bar linkage 114 since the interconnection between each of the links of non-actuated four-bar linkage 116 is through low friction bearings and none are positively actuated. Since the four-bar linkages 114 and 116 share a common element, namely link 108, they are said to be parallel and coupled four-bar linkages.

This concept of coupling between actuated and non-actuated four-bar linkages and their interrelationship to enhance stability is true in precisely the manner described above in connection with the horizontal motion actuator assembly 26. This symmetry is evident, particularly with reference to FIG. 1. In that case, the actuated four-bar linkage is comprised of links defined by swing arm assembly 48 and water lance 28 and additionally by a spoke 86 and the structure of mounting plate assembly 100. The non-actuated four-bar linkage is in turn also comprised of links defined by linkage arm 58 acting with water lance 28, as well as the associated stabilizing ring assembly spoke 86 and mounting plate assembly 100.

Through coordinated actuation of the vertical and horizontal motor units 64 and 44, a range of angular positions for water lance 28 can be provided. FIGS. 3 and 4 illustrate stabilizing ring assembly 22 displaced to a vertical upper position and FIG. 6 shows displacement in the left hand position. In a similar manner, this displacement can occur to the right and lower positions. Thus the range of motion of stabilizing ring assembly 22 can be defined as a square or rectangle when viewing the unit in a frontal elevational view. It may be also be located at any position within the area prescribed by such a square or rectangle and thus a range of positions can be achieved for water lance 28.

The cleaning device 10 in accordance with this invention enables the vertical and horizontal motion of water lance 28 to be accomplished purely through the use of rotary motion actuators 44 and 64. The four-bar linkages described previously convert the rotational motion of actuators 44 and 64, which are fixed in their position into the controlled motion of the outboard Cardon joint 32 through a set of spherical coordinates having a fixed radial dimension. This radial coordinate is the length of the linkage system between the inboard and outboard Cardon joints 30 and 32. The use of rotary motion actuators provides a number of significant benefits over prior art systems, which typically rely on linear actuators. Linear actuator systems, or systems utilizing an X-Y coordinate actuator system, are more subject to contamination, jamming, and wear.

While the above description constitutes the preferred embodiment of the present invention, it will be appreciated that the invention is susceptible to modification, variation and change without departing from the proper scope and fair meaning of the accompanying claims.

What is claimed is:

1. An articulating monitor cleaning device for projecting a stream of a fluid into a combustion device having an interior volume and an exterior wall with a wall port through said exterior wall, said device comprising:

a lance tube adapted to receive said fluid and eject said fluid into said interior volume;

a first articulating joint coupled to said lance tube at a first position adjacent said nozzle adjacent said wall port;

a second articulating joint coupled to said lance tube at a second position displaced from said first position;

a horizontal motion actuator assembly including an actuated horizontal motion four-bar linkage coupled with said second articulating joint for causing said second articulating joint to be displaceable horizontally with respect to said first articulating joint; and a vertical motion actuator assembly including an actuated vertical motion four-bar linkage coupled with said second articulating joint for causing said second articulating joint to be displaceable vertically with respect to said first articulating joint, whereby coordinated actuation of said horizontal motion actuator assembly and said vertical motion actuator assembly enables a range of angular positions of said lance tube to be set such that the direction of discharge of said fluid into said combustion device may be controlled.

2. An articulating monitor cleaning device according to claim 1 wherein said fluid is water.

3. An articulating monitor cleaning device according to claim 1 wherein said first articulating joint is a Cardon joint which enables angular displacement of said lance tube about vertical and horizontal axes.

4. An articulating monitor cleaning device according to claim 1 wherein said second articulating joint is a Cardon joint which enables angular displacement of said lance tube about vertical and horizontal axes.

5. An articulating monitor cleaning device according to claim 1 wherein said cleaning device further comprises a stabilizing ring assembly mounting said second articulating joint at its center and a mounting plate for mounting said cleaning device to said combustion device exterior wall.

6. An articulating monitor cleaning device according to claim 5 wherein said stabilizing ring assembly comprises an outer ring and an inner ring with a plurality of spokes interconnecting said rings, said inner ring mounting said second articulating joint.

7. An articulating monitor cleaning device according to claim 6 wherein said outer ring and said inner ring lie on parallel but displaced planes with said inner ring positioned closer to said wall port than said outer ring.

8. An articulating monitor cleaning device according to claim 5 wherein said horizontal motion linkage assembly further comprises a vertical axle mounted for rotation relative to said exterior wall and being driven for rotation by said horizontal motion actuator, and a first swing arm mounted to said vertical axle, said first swing arm being freely rotatable relative to said vertical axle about a horizontal axis but rotating with said vertical axle about a vertical axis, an end of said first swing arm coupled with said stabilizing ring assembly whereby actuation of said horizontal motion actuator causes said stabilizing ring assembly to shift in the horizontal direction.

9. An articulating monitor cleaning device according to claim 8 wherein said actuated horizontal motion four-bar linkage is comprised by a first set of opposing links formed by said first swing arm assembly and said lance tube, and a second set of opposing links formed by said stabilizing ring assembly and said mounting plate.

10. An articulating monitor cleaning device according to claim 9 wherein said first set of links have lengths equal to one another and said second set of links have lengths equal to one another whereby said actuated horizontal motion four-bar linkage comprises a parallelogram linkage.

11. An articulating monitor cleaning device according to claim 9 wherein said cleaning device further comprises a non-actuated horizontal motion four-bar linkage formed by a first set of opposing links formed by a first linkage arm mounted by a pair of flexible joints to said stabilizing ring assembly and said mounting plate and said lance tube, and a second set of opposing links formed by said stabilizing ring assembly and said mounting plate, said non-actuated horizontal motion four-bar linkage acting in parallel with said actuated horizontal motion four-bar linkage to stabilize said stabilizing ring assembly.

12. An articulating monitor cleaning device according to claim 5 wherein said vertical motion linkage assembly further comprises a horizontal axle mounted for rotation relative to said exterior wall and being driven for rotation by said vertical motion actuator, and a second swing arm mounted to said horizontal axle, said second swing arm being freely rotatable relative to said horizontal axle about an axis normal to said horizontal axle but rotating with said horizontal axle about a horizontal axis, an end of said second swing arm coupled with said stabilizing ring assembly whereby actuation of said vertical motion actuator causes said stabilizing ring assembly to shift in the vertical direction.

13. An articulating monitor cleaning device according to claim 12 wherein said actuated vertical motion four-bar linkage is comprised by a first set of opposing links formed by said second swing arm assembly and said lance tube, and a second set of opposing links formed by said stabilizing ring assembly and said mounting plate.

14. An articulating monitor cleaning device according to claim 13 wherein said first set of links have lengths equal to one another and said second set of links have lengths equal to one another whereby said actuated vertical motion four-bar linkage comprises a parallelogram linkage.

15. An articulating monitor cleaning device according to claim 14 wherein said cleaning device further comprises a non-actuated vertical motion four-bar linkage formed by a first set of opposing links formed by a second linkage arm mounted by a pair of flexible joints to said stabilizing ring assembly and said mounting plate and said lance tube, and a second set of opposing links formed by said stabilizing ring assembly and said mounting plate, said non-actuated vertical motion four-bar linkage acting in parallel with said actuated vertical motion four-bar linkage to stabilize said stabilizing ring assembly.

16. An articulating monitor cleaning device according to claim 1 wherein said first articulating joint is coupled to said lance tube allowing axial displacement of said lance tube relative to said first articulating joint, and said second articulating joint is coupled to said lance tube to restrain thrust loads acting on said lance tube.

17. An articulating monitor cleaning device according to claim 1 wherein said horizontal motion actuator assembly includes a rotary horizontal motion actuator and said vertical motion actuator assembly includes a rotary vertical motion actuator.

18. An articulating monitor cleaning device for projecting a stream of a fluid into a combustion device having an interior volume and an exterior wall with a wall port through said exterior wall, said device comprising:

a lance tube adapted to receive said fluid and having a nozzle for ejecting said fluid into said interior volume;

a first articulating joint coupled to said lance tube at a first position adjacent said nozzle and mounted adjacent said wall port;

a second articulating joint coupled to said lance tube at a second position displaced from said first position;

a horizontal motion actuator assembly including an actuated horizontal motion four-bar linkage coupled with said second articulating joint and a horizontal motion rotary actuator coupled with said horizontal motion four-bar linkage for causing said second articulating joint to be displaceable horizontally with respect to said first articulating joint; said horizontal motion actuator assembly further including a non-actuated horizontal motion four-bar linkage coupled with said second articulating joint and acting in parallel with said actuated horizontal motion four-bar linkage, a vertical motion actuator assembly including an actuated vertical motion four-bar linkage coupled with said second articulating joint and an a vertical motion rotary actuator coupled with said vertical motion four-bar linkage for causing said second articulating joint to be displaceable vertically with respect to said first articulating joint, said vertical motion actuator assembly further including a non-actuated vertical motion four-bar linkage coupled with said second articulating joint and acting in parallel with said actuated vertical motion four-bar linkage, whereby coordinated actuation of said horizontal motion actuator assembly and said vertical motion actuator assembly enables a range of angular positions of said lance tube to be set such that the direction of discharge of said fluid into said combustion device may be controlled.

19. An articulating monitor cleaning device according to claim 18, said horizontal motion actuated and non-actuated four-bar linkages and said vertical motion actuated and non-actuated four-bar linkages each share said lance tube as a common link.

20. An articulating monitor cleaning device according to claim 18, said horizontal motion actuated and non-actuated four-bar linkages and said vertical motion actuated and non-actuated four-bar linkages each comprise parallelogram linkages.

21. An articulating monitor cleaning device according to claim 18 wherein said first articulating joint is coupled to said lance tube allowing axial displacement of said lance tube relative to said first articulating joint, and said second articulating joint is coupled to said lance tube to restrain thrust loads acting on said lance tube.

22. An articulating monitor cleaning device for projecting a stream of a fluid into a combustion device having an interior volume and an exterior wall with a wall port through said exterior wall, said device comprising:

a seal box assembly mounted to said boiler wall and forming said wall port, a mounting plate adapted to be mounted to said seal box assembly, fasteners for affixing said mounting plate assembly to said seal box assembly, a lance tube adapted to receive said fluid and having a nozzle for ejecting said fluid into said interior volume;

a first articulating joint coupled to said lance tube at a first position adjacent said nozzle and mounted to said mounting plate assembly adjacent said wall port;

a second articulating joint coupled to said lance tube at a second position displaced from said first position;

a horizontal motion actuator assembly mounted to said mounting plate assembly for causing said second articulating joint to be displaceable horizontally with respect to said first articulating joint; and a vertical motion actuator assembly mounted to said mounting plate assembly for causing said second articulating joint to be displaceable vertically with respect to said first articulating joint, whereby coordinated actuation of said horizontal motion actuator assembly and said vertical motion actuator assembly enables a range of angular positions of said lance tube to be set such that the direction of discharge of said fluid into said combustion device may be controlled.

* * * * *